US007040826B2

(12) United States Patent
Terry et al.

(10) Patent No.: US 7,040,826 B2
(45) Date of Patent: May 9, 2006

(54) IMAGING DEVICES AND RELATED CLEANING MEANS

(75) Inventors: James P. Terry, Garden Valley, ID (US); William W. Uhl, Boise, ID (US); James R. Nelson, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/356,777

(22) Filed: Jan. 31, 2003

(65) Prior Publication Data

US 2004/0151528 A1 Aug. 5, 2004

(51) Int. Cl.
*B41F 35/00* (2006.01)
*B41J 29/17* (2006.01)

(52) U.S. Cl. ..... 400/701; 101/424; 101/425; 399/264

(58) Field of Classification Search ..... 400/691, 400/701, 719; 101/425, 180; 347/25, 34; 399/264; B41J 29/377
See application file for complete search history.

(56) References Cited

U.S. PATENT DOCUMENTS

| | | | | |
|---|---|---|---|---|
| 4,610,534 | A | 9/1986 | Ito et al. | |
| 4,861,178 | A | 8/1989 | Reed | |
| 5,704,135 | A * | 1/1998 | Riahi | 34/546 |
| 6,402,293 | B1 * | 6/2002 | Sawicki | 347/36 |
| 2002/0071691 | A1 * | 6/2002 | Jones et al. | 399/91 |

FOREIGN PATENT DOCUMENTS

JP 57-171369 * 10/1982

* cited by examiner

*Primary Examiner*—Andrew H. Hirshfeld
*Assistant Examiner*—Marissa Ferguson

(57) ABSTRACT

Imaging apparatus in accordance with the present invention generally include a housing and a portal defined therethrough, whereby a vacuum filter cartridge can be placed in an operable position within the housing by way of the portal. The vacuum filter cartridge can have a hose operatively connected thereto. Air can be induced to flow into and through the hose, and thereby into and through the vacuum filter cartridge. The airflow can have a velocity sufficient to cause debris to be inducted into the hose and into the vacuum filter cartridge to be filtered, thus rendering the vacuum filter cartridge and hose operable as a cleaning device.

18 Claims, 4 Drawing Sheets

IMAGING DEVICES AND RELATED CLEANING MEANS

BACKGROUND OF THE INVENTION

Various types of imaging devices for producing visual images on media are well known in the art. Once specific type of imaging device is that known as the "electrophotographic" imaging device. Such electrophotographic imaging devices are often referred to as "laser printers." Electrophotographic imaging devices generally employ a dry, powdered substance for producing images in accordance with the associated electrophotographic imaging methods. This dry, powdered substance is most commonly known as "toner."

Electrophotographic imaging devices generally include a toner storage device in which toner is stored until needed for use in producing images. Such toner storage devices are generally in the form of a hopper or the like for containing a given quantity of toner. Such toner hoppers can be of the integral type or of the removable type in which case the hopper device is generally referred to as a "toner cartridge."

Inasmuch as the typical electrophotographic imaging device consumes quantities of toner in conjunction with the production of images, the toner hopper device must be periodically replenished with toner. Alternatively, the toner cartridges of a given electrographic imaging device must periodically be replaced with replenished cartridges. Invariably, at least in part because of the extremely fine, dust-like nature of toner in general, some toner spillage often occurs at the electrophotographic imaging device during toner replenishment.

Additionally, toner sometimes tends to leak from the toner container and to accumulate in certain areas of typical electrophotographic imaging device as a result of normal operation thereof. Moreover, a toner spill within an electrophotographic imaging device can occur as the result of an operational malfunction such as a component failure, or a user error. Consequently, such accumulation and/or spillage of toner within the typical electrophotographic imaging device results in toner contamination thereof, which can lead to unacceptable performance of the imaging device, or in some cases, damage thereto. At a minimum, such toner contamination or leakage can be an inconvenience due to smudging of toner onto clothing, documents, and hands.

Thus, as is to be expected, cleanup of the toner contamination is oftentimes desirable. Responsively, vacuum cleaners and the like have been employed for use in cleanup of toner spillage and accumulation. While such vacuum cleaners have performed satisfactorily, several disadvantages can be associated therewith. For example, vacuum cleaners typically can be relatively bulky. Specifically, a large portion of the mass and/or size of a typical vacuum cleaner used for cleaning toner spillage can be attributed to the vacuum cleaner motor and/or fan assembly.

Service technicians and/or users who are responsible for maintaining electrophotographic imaging devices are often burdened with problems associated with storing, moving, and handling of such conventional vacuum cleaners. Such problems can be especially burdensome for service technicians who travel from site to site and who must often carry with them, in addition to a vacuum cleaner, a variety of needed tools, parts, and supplies.

Various prior art imaging devices are known which incorporate vacuum cleaner systems. One example of such an imaging device is disclosed in U.S. Pat. No. 4,610,534 to Ito et al. Ito et al. describe a vacuum cleaner system that is configured to collect residual toner from the photoconductive surface of an electrophotographic imaging apparatus.

Specifically, the vacuum cleaner system of Ito is integrally mounted within an electrophotographic imaging device, whereby the vacuum cleaner system is configured to automatically collect residual toner from the photoconductive drum with the aid of a rotating brush in contact with the drum. The brush is operatively mounted within a substantially enclosed chamber having an outlet connection to which a vacuum source and filter is connected.

While the vacuum cleaner system of Ito is known to function satisfactorily in collecting residual toner from the photoconductive drum of an electrophotographic imaging device, it is not suited, nor is it configured, to collect residual toner from any other area or component of an imaging device. Thus, the vacuum cleaner system of Ito cannot be employed for cleaning toner accumulation which occurs in various areas of an electrophotographic imaging device as described above.

Another example of an imaging device having an integral vacuum cleaner system is described in U.S. Pat. No. 4,861,178 to Reed. Reed discloses an imaging device having a media feeder and an integral vacuum attachment operatively mounted adjacent the media feeder. As is evident from the placement of the vacuum attachment of Reed in a position which is adjacent to the media feeder, the primary function of the vacuum attachment is to collect dust, dirt, and other debris directly from the media itself, and/or from the immediate area surrounding the media feeder.

While various alternative locations of the vacuum attachment of Reed can result in collection of debris from various areas of an imaging apparatus in which the attachment is located, the fixed mounting of the vacuum attachment does not facilitate ease of cleanup of toner in various areas of a typical electrophotographic imaging device as is described above. That is, the vacuum cleaner system of Reed is configured to clean only specific, predetermined areas of an imaging device, and is not configured to clean up targeted areas on an "as required" basis.

What is needed then is an imaging device cleaning apparatus that achieves the benefits to be derived from similar prior art apparatus and methods, but which avoids the shortcomings and detriments individually associated therewith.

SUMMARY OF THE INVENTION

In accordance with one embodiment of the present invention, an imaging apparatus includes an imaging portion that is configured to produce images on media. A housing which substantially encloses the imaging portion is also included in the imaging apparatus. A portal is defined through the housing, wherein a vacuum filter cartridge can be placed in an operable position within the housing by way of the portal. A hose can be operatively attached to the vacuum filter cartridge, and an airflow can be induced through the hose and/or the vacuum filter cartridge.

DETAILED DESCRIPTION

The various embodiments of the present invention generally pertain to cleaning means that can be employed in conjunction with imaging devices. Generally, at least one embodiment of the present invention includes apparatus which can be employed to remove debris and the like from in and around an imaging device such as an electrophotographic imaging apparatus that employs powdered toner imaging substance. In accordance with one embodiment of the present invention, an imaging apparatus having an outer housing and a fan is configured to selectively receive within the housing a vacuum filter cartridge. The vacuum filter cartridge can include a hose operatively attached thereto.

The vacuum filter cartridge can be configured to be placed in an operable position within the imaging device and relative to the fan, whereby the fan induces airflow through the cartridge, thereby rendering the cartridge functional as a cleaning device. The vacuum filter cartridge can include an outer shell and a filter element which together substantially enclose a vacuum chamber and/or a particulate trap.

Figure 1:
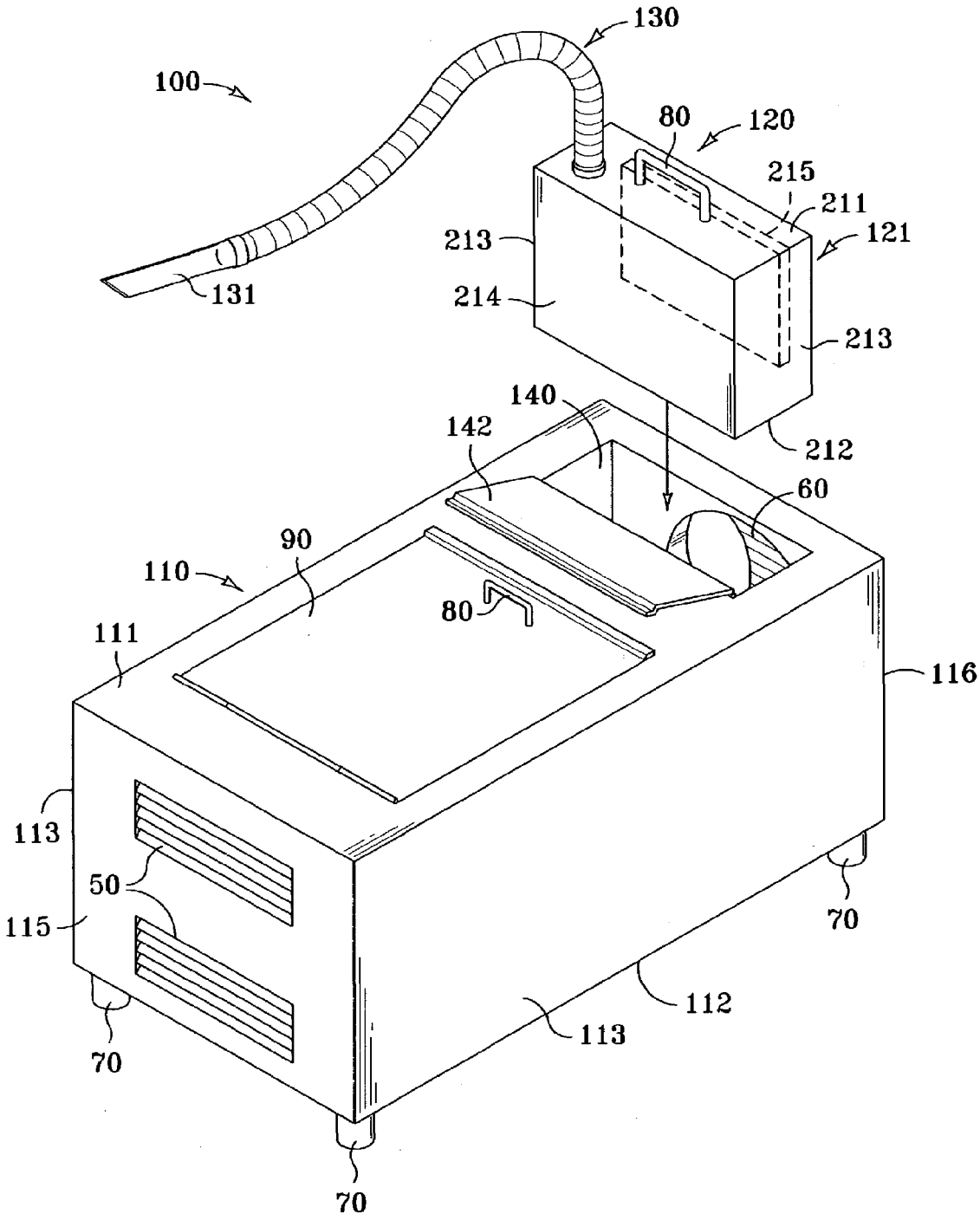
FIG. 1 is an isometric view of an imaging apparatus in accordance with one embodiment of the present invention.

With reference to FIG. 1, an isometric view is shown in which an imaging apparatus 100 is depicted in accordance with one embodiment of the present invention. The imaging apparatus 100 can include a housing 110 which can function as an enclosure or the like for various components of the imaging apparatus as is described in further detail below. The housing 110 can be fabricated from any of a number of available materials including sheet metal and/or molded plastic. The imaging apparatus 100 can also include a plurality of legs 70, or feet, which can support the imaging apparatus on a suitable surface such as a tabletop, shelf, floor, or the like.

The housing 110 can be provided with a substantially rectilinear profile and cross-section as is evident from a view of FIG. 1. However, it is understood that the housing 110 can have any shape, including a non-rectilinear shape. If the housing 110 is provided with a substantially rectilinear shape as is depicted, then the housing can be divided into a number of rectilinear panels or facets. For example, the housing 110 can include a substantially flat top panel 111 and an opposite substantially flat bottom panel 112.

The housing 110 can also include a pair of substantially flat side panels 113, as well as a substantially flat front panel 115 and a substantially flat back panel 116. The top panel 111 and the bottom panel 112 can be oriented in substantially parallel, spaced-apart, juxtaposed relation to one another, as is depicted.

Likewise, each of the side panels 113 can also be oriented in substantially parallel, spaced-apart, juxtaposed relation to one another, as can be the front panel 115 and the back panel 116, respectively. The side panels 113 as well as the front panel 115 and the back panel 116 can extend between, and substantially normal to, the top panel 111 and the bottom panel 112. Similarly, each of the side panels 113 can be substantially normal to both the front panel 115 and the back panel 116, as is shown.

The imaging apparatus 100 can also include a vacuum filter cartridge 120 that is described in detail further below. With continued study of FIG. 1, it is seen that a portal 140, or opening, is defined through the housing 110. The portal 140 can be defined through the top panel 111 of the housing as is shown. The vacuum filter cartridge 120 can be operatively positioned within the housing 110 by way of the portal 140 as is described in greater detail below. That is, the term "portal" as used herein is defined as an opening in the housing 110 through which opening the vacuum filter cartridge 120 can be operatively positioned within the housing as is described herein below.

The vacuum filter cartridge 120 can be rectilinearly shaped as in the manner depicted and as is described above with respect to the housing 110. However, it is understood that the vacuum filter cartridge 120 can have any shape, including a non-rectilinear shape. If the vacuum filter cartridge 120 is provided with a rectilinear shape, it can include a substantially flat top panel 211 and an opposite substantially flat bottom panel 212, wherein the top panel and the bottom panel can be oriented in substantially parallel, spaced-apart, juxtaposed relation to one another.

Additionally, the vacuum filter cartridge 120 can include a pair of substantially flat side panels 213 which are oriented in substantially parallel, spaced-apart, juxtaposed relation to one another, and which can extend between, and substantially parallel to, the top panel 211 and the bottom panel 212. The vacuum filter cartridge 120 also can include a substantially flat front panel 214. The front panel 214 can be oriented substantially normally to the side panels 213 as well as to the top panel 211 and the bottom panel 212. A filter element 215 can also be included in the vacuum filter cartridge 120. The filter element can be substantially flat and oriented in parallel, spaced-apart, juxtaposed relation to the front panel. The filter element 215 is discussed in greater detail below.

The vacuum filter cartridge 120 can also include a handle 80 that is attached to the shell 121 to facilitate placement of the cartridge into its operable position within the housing, as well as to facilitate removal therefrom of the cartridge. The handle 80 can be attached to the top panel 211 as is depicted. A flexible hose 130 can also be included in the apparatus 100, wherein the hose is operatively connectable with the vacuum filter cartridge 120. The hose 130 can include a nozzle 131 that is attached to one end of the hose as is depicted. The function of the hose 130 is described in greater detail below.

As is further seen from a view of FIG. 1, the portal 140 can be shaped and/or sized so as to be only slightly larger than the "footprint," or cross-sectional dimensions, of the vacuum filter cartridge 120. That is, the portal 140 can be shaped so as to be only slightly larger than the top panel 211, as well as the bottom panel 212, of the vacuum filter cartridge 120. In this manner, the portal 140 can serve to guide the vacuum filter cartridge 120 into, and/or retain the vacuum filter cartridge in, its operable position within the housing 110 which is described in greater detail below.

The apparatus 100 can also include a portal panel 142 that is configured to be selectively positionable over the portal 140 to cover the portal when the vacuum filter cartridge 120 is not in its operable position within the housing 110. That is, the portal panel 142 can be configured to function as a selectively positionable door for the portal 140 which can be moved so as to expose the portal 140.

The portal panel 142 can be movably connected to the housing 110. For example, the portal panel 142 can be pivotally attached to the housing 110 by way of hinges (not shown) or the like, so as to swing into an open position as is depicted in FIG. 1. Alternatively, the portal panel 142 can be movably attached to the housing 110 by way of other means such as slide mounts (not shown) or the like. As yet a further alternative, the portal panel 142 can be separate from the housing 110 in which case the portal panel can be lifted from the housing 110 and completely removed therefrom.

The apparatus 100 can include various other movable panels, such as the panel 90 which is shown to be pivotally supported on the top panel 111. As can be appreciated, the additional panel 90 can serve to provide access to various components of the apparatus 100 which are internal to the housing 110, as is also described in greater detail below. The panel 90 can have a handle 80 mounted thereon to facilitate manual movement of the panel.

As is further seen from an examination of FIG. 1, one or more inlet openings 50 can be defined through the housing 110. Similarly, one or more outlet openings 60 can be defined through the housing 110 as well. The inlet opening 50 and outlet opening 60 can be defined in opposite panels of the housing 110. For example, the inlet opening 50 can be defined through the front panel 115 of the housing 110, while the outlet opening 60 can be defined through the back panel 116 as is depicted.

However, it is understood that the inlet opening 50 and/or the outlet opening 60 can have any of a number of possible locations and/or configurations that are not specifically shown or described herein. That is, the purpose of the inlet opening 50 is to allow air into the housing 110, while the purpose of the outlet opening 60 is to allow air to flow out of the housing. Thus, the configuration and/or location of the inlet opening 50 and the outlet opening 60, relative to the housing 110, need only be limited so as to enable the inlet opening and outlet opening to serve their intended purposes.

Moving now to FIG. 2, a side elevation schematic diagram is shown in which the apparatus 100 is depicted in a conventional operational mode as is further explained below. As is seen, the apparatus 100 is shown to be resting on a surface SS. A fan 170 can be included in the apparatus 100. The fan 170 can be supported in an operable position within the housing 110. More specifically, the fan 170 can be supported in an operable position that is substantially adjacent to the outlet opening 60, as is shown. Moreover, the fan 170 can be made up of both a motor portion 171 and a blade portion 172 that is operatively connected with the motor portion.

The fan 170 can be configured to be operable so as to induce an airflow AF through the housing 110 by way of the inlet opening 50 and the outlet opening 60. In other words, the fan 170 can be operated so as to induce airflow AF into the housing 110 by way of the inlet opening 50, then through the housing, and then out of the housing by way of the outlet opening 60. The airflow AF through the housing 110 can serve, for example, to cool various components that are internal to the housing, as is discussed in further detail below.

The motor portion 171 of the fan 170 can include, by way of example only, an electric motor or the like, as is the case with regard to many conventional fans. It is understood that the blade portion 172, although depicted in an axial blade configuration, can be configured in one of a number of alternative manners. For example, the blade portion 172 can alternatively have a centrifugal blade configuration. As yet a further alternative, the blade portion 172 can have a squirrel-cage blade configuration. Various other fan blade configurations are known in the art, but are not shown or discussed herein.

A wall 161 can be included in the apparatus 100 as is depicted. The wall 161 can be supported within the housing 110 in the general manner depicted in FIG. 2. That is, the wall 161 can operatively enshroud the blade portion 172 of the fan 170. By so enshrouding the blade portion 172 of the fan 170, the wall 161 can form a duct opening 160. As is seen, substantially all of the airflow AF can pass through the duct opening 160 by way of operation of the fan 170 before passing through the outlet opening 60 and exiting the housing 110.

As is further seen, a cartridge bay 150 can be defined within the housing 110. The cartridge bay 150 is the general area within the housing 110 which is occupied by the vacuum filter cartridge 120 when the cartridge is placed in its operable position within the housing 110. The cartridge bay 150 can be at least partially defined by the wall 161, as well as by one or more guides 151 which can also be included in the apparatus 100. The guides 151 can be supported within the housing 110 as shown, and can serve to positionally support the vacuum filter cartridge 120 when the cartridge occupies the cartridge bay 150.

The fan 170 can be configured to selectively and alternately operate at a high-power setting and at a low-power setting. Specifically, the fan 170 can be configured in such a manner that, when the fan is operating at the high-power setting, a relatively high amount of mechanical power is applied to the airflow AF. Conversely, the fan 170 can be configured so that a relatively low amount of mechanical power is applied to the airflow AF at the low-power setting.

Thus, when operated at the high-power setting, the fan 170 can be capable of inducing a relatively high flow rate, and/or a relatively high static pressure, and/or a relatively high vacuum with regard to respective region of the apparatus 100. The converse can be true with regard to the operation of the fan 170 at the low-power setting. The significance of the high-power setting and low-power setting of the fan 170 becomes more apparent with regard to the discussion that follows further below.

The fan 170 can be configured to attain the high-power setting and low-power setting in any of a number of possible manners. For example, the motor portion 171 of the fan 170 can include a multi-speed motor that is capable of operating alternately at both a high operational speed and a low operational speed. Thus, in such a case, the high-power setting of the fan 170 can be attained by operating the motor portion 171 at the high operational speed, which results in the blade portion 172 rotating at a relatively high speed. Conversely, the low-power setting of the fan 170 can be attained by operating the motor portion 171 at the low operational speed, resulting the in the blade portion 172 rotating at a relatively low speed.

Alternatively, the blade portion 172 of the fan 170 can be configured as a multi-positional blade having a high-power setting and a low-power setting. That is, in such a case, the motor portion 171 can comprise a constant-speed motor, while the blade portion 172 can be selectively changeable, by way of example only, between a high-pitch, high-power setting and a low-pitch, low-power setting. In this manner, when the blade portion 172 of the fan 170 is set at the high-pitch setting, the motor portion 171 can consequently draw more power which is mechanically transferred to the airflow AF. Conversely, when the blade portion 172 is set at the low-pitch setting, the motor portion 171 can draw less power.

Other means of attaining a high-power setting and a low-power setting for the fan 170 are possible. For example, the fan 170 can comprise a plurality of single-speed fans, each including constant-speed motor portions 171 and fixed-pitch blade portions 172, that are individually selectively operable. Specifically, for example, the fan 170 can comprise two like fans, wherein only one fan is operated to attain the low-power setting and both fans are simultaneously operated to attain the high-power setting. In that a case, such a plurality of fans can be arranged either in a series orientation and/or in a parallel orientation with regard to the airflow AF.

Figure 2:
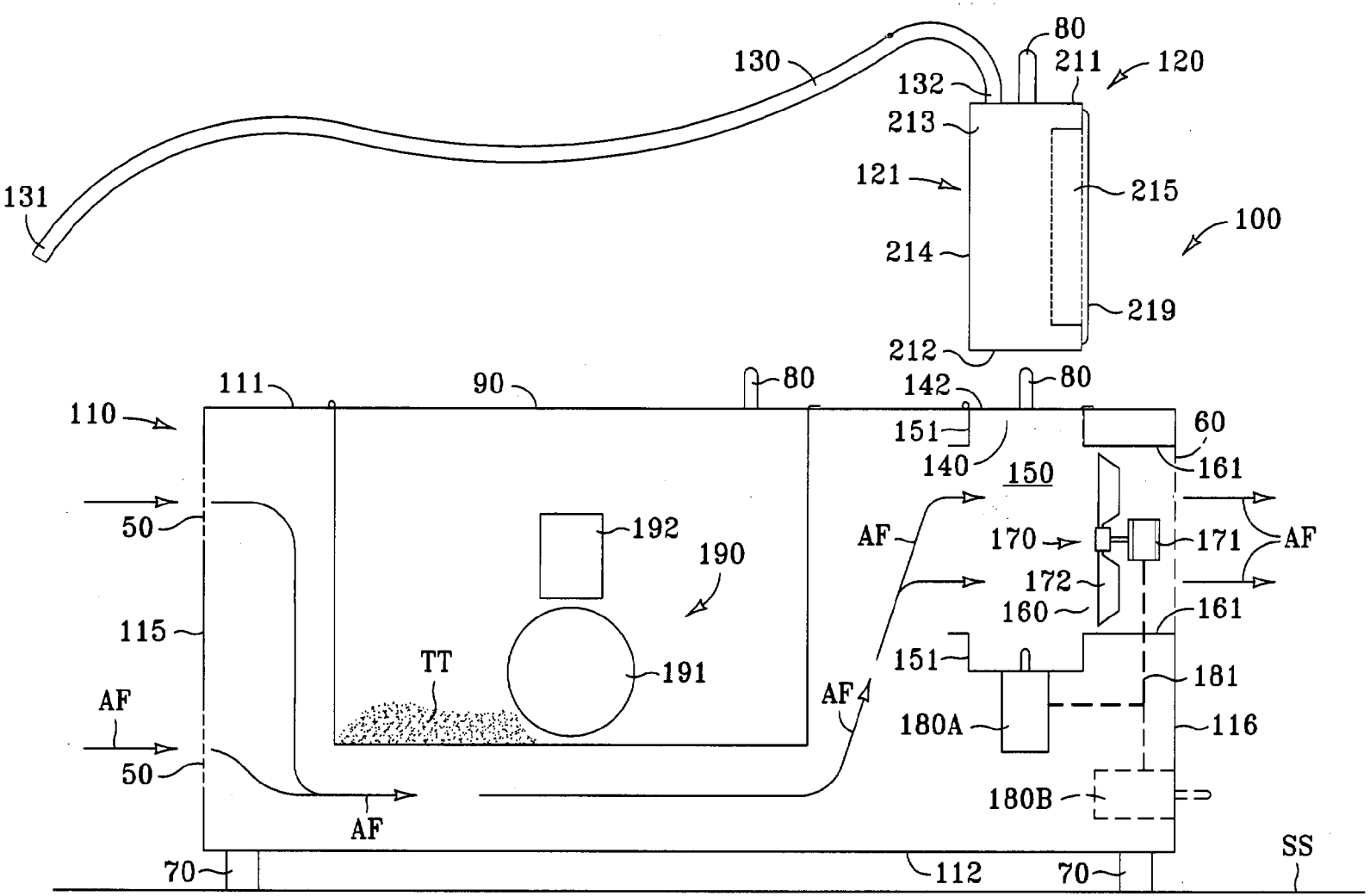
FIG. 2 is a side elevation schematic drawing of the imaging apparatus depicted in FIG. 1 showing the imaging apparatus in conventional operational mode.

As is further seen from an examination of FIG. 2, the apparatus 100 can include an imaging portion 190. The imaging portion 190 is configured to produce images on media (not shown) in the manner of typical conventional imaging portions. That is, for example, the imaging portion 190 can include a photoconductive drum 191 and a toner hopper 192 in the manner of a conventional electrophotographic imaging device. Imaging portions such as the imaging portion 190 are well known in the art as discussed above with regard to the prior art, and are thus not described in further detail herein.

As is also depicted, various debris TT such as spilled and/or accumulated toner, and the like, can collect within the housing 110 of the imaging apparatus 100 in the manner discussed above with respect to the prior art. The presence of such debris TT within the housing 110, and especially adjacent to the imaging portion 190, can detrimentally effect the operation of the imaging apparatus 100, and can result in various annoyances as is discussed above with respect to the prior art. As is also briefly mentioned above, the imaging portion 190 can be accessed by way of the panel 90. That is, more specifically, the panel 90 can be opened to reveal the imaging portion 190 and to provide access thereto for cleaning and/or repairs and the like, as is discussed in greater detail below.

Still referring to FIG. 2, the imaging apparatus 100 can include a switch 180A, 180B. The suffixal alphabetic designations ("A" and "B," respectively) of the switch 180A, 180B indicate the respective alternative locations of the switch relative to the housing 110, as well as the respective configuration of the switch itself as is explained further below. That is, the switch 180A indicates one location and/or configuration, while the switch 180B indicates an alternative, or additional, location and/or configuration. The switch 180A, 180B is connected in operable relation to the fan 170, whereby activation of the switch effects the operation of the fan. In other words, the switch 180A, 180B can be connected to the fan 170 in a manner whereby the power setting of the fan is controllable by the switch.

Specifically, the switch 180A, 180B can be connected with the fan 170 in a manner wherein activation of the switch causes the fan to operate at the high-power setting and deactivation of the switch causes the fan to operate at the low-power setting, or vice versa. That is, the switch 180A, 180B can be connected with the fan 170 in a manner in which selective activation and deactivation of the switch results in selective control of the fan with regard to the power setting thereof. The switch 180A, 180B can be connected to the fan 170 via a control linkage 181, such as a rod, cable, wire, optical fiber, or the like, as is known in the art.

As is mentioned above, the switch 180A, 180B can have one of several different configurations and can be operatively supported in one of several respective locations relative to the housing 110. For example, in accordance with one alternative configuration, the switch 180A can be supported within the housing 110 and can be located relative thereto such that placement of the vacuum filter cartridge 120 into the cartridge bay 150 by way of the portal 140 automatically results in activation of the switch, and thus, control of the power setting of the fan 170.

More specifically, the switch 180A can be a proximity switch that is operatively supported within the housing 110 and located relative thereto, whereby placement of the vacuum filter cartridge 120 into its operable position results in bringing the vacuum filter cartridge into proximity, and/or contact, with the switch, thereby causing the switch to be activated, and whereby removal of the vacuum filter cartridge from its operable position within the housing causes deactivation of the switch.

In this manner, the switch 180A can be said to operate the fan automatically in response to the presence or non-presence of the vacuum filter cartridge 120 in its operable position within the housing 110. As can be appreciated, such automatic control of the fan 170 can serve to simplify the use of the apparatus 100, wherein the fan is automatically switched to the high-power setting simply by placement of the vacuum filter cartridge 120 into its operable position within the housing, and wherein the fan is automatically switched to the low-power setting when the vacuum filter cartridge is removed from its operable position within the housing.

It is understood that, although the term "proximity switch" is known in the art and can have various specific meanings under certain circumstances, the term "proximity switch" as used herein includes any type of switch and/or sensor that can be activated by proximity to, and/or contact with, the vacuum filter cartridge 120 in such a manner whereby the intended purpose of the switch 180A as described herein can be accomplished. Thus, the term "proximity switch" as used herein can include limit switches, photo-eyes, and other like forms of sensors that are configured to detect the presence or non-presence of an object at a given location.

Alternatively, or in addition, the switch 180B can be configured so as to be manually operable. That is, the switch 180B can be configured in a manner so as to be operated via manipulation thereof by an operator or the like. In such a case, the switch 180B can be supported on the housing 110 and located relative thereto, whereby manual operation of the switch is facilitated. That is, for example, the switch 180B can be located near the exterior of the housing 110 so that it is easily accessible for operation by a user of the apparatus 100.

In such a case, the vacuum filter cartridge 120 can be first placed in its operable position within the housing 110, and then the switch 180B can be manually activated to operate the fan 170 in the high-power setting. Likewise, the switch 180B can be manually deactivated to operate the fan in the low-power setting before removal of the vacuum filter cartridge 120 from its operable position. As can be appreciated, in this manner, the fan 170 can be switched between the high-power setting and the low-power setting without regard to whether the vacuum filter cartridge is in its operable position within the housing 110.

In yet a further alternative configuration, both locations/configurations of the switch 180A, 180B can be employed simultaneously in a given apparatus 100. That is, two switches 180A, 180B can be employed in one apparatus as is depicted. In such a case, a proximity switch 180A can be controllably connected to the fan 170 and positioned to automatically detect the presence and/or non-presence of the vacuum filter cartridge 120 within its operable position within the housing 110 as is described above.

Additionally, a manually operable switch 180B can be controllably connected to the fan 170 and positioned to be manually operable by a user of the apparatus 100. In this manner, both of the switches 180A, 180B can be operatively connected to the fan 170 and can be configured such that the fan can be manually switched to the high-power setting, but only if the vacuum filter cartridge 120 is in its operable position within the housing 110. That is, in such a case, the fan 170 is configured to be operable in the high-power setting only if both switches 180A, 180B are activated.

As is also seen from an examination of FIG. 2, the vacuum filter cartridge 120 can include a filter element 215 as is mentioned above. The filter element 215 can be specifically configured for its intended purpose. That is, for example, if the vacuum filter cartridge 120 is intended to be used in conjunction with an electrophotographic imaging apparatus, then the filter element 215 can be configured to trap fine particles such as powdered toner and the like. The vacuum filter cartridge 120 can further include a seal 219, or gasket, which can serve to seal the vacuum filter cartridge against the wall 161 when the cartridge is placed into the cartridge bay 150. The significance of the seal 219 is more apparent with regard to further discussion below.

As is seen from a study of FIG. 2, relative to the housing 110, the vacuum filter cartridge 120 is depicted as being positioned in anticipation for placement thereof into the cartridge bay 150. That is, the vacuum filter cartridge 120 is shown to be positioned for placement thereof into its operable position within the housing 110. However, with the vacuum filter cartridge 120 not yet placed into the cartridge bay 150, and with the portal panel 142 in the closed position whereby the portal 140 is substantially blocked, it can be said that the imaging apparatus 100 is shown to be operating in a conventional mode.

That is, as is depicted in FIG. 2, the imaging apparatus 100 is in a conventional operating mode, wherein the operation of the fan 170, and its effect on the airflow AF, can be similar to that of a conventional imaging apparatus. Specifically, in the configuration depicted in FIG. 2, the fan 170 can operate at the low-power setting, whereby a given amount of airflow AF is induced to move through the housing 110 by first entering through the inlet opening 50, and then flowing about the imaging portion 190, and then flowing through the cartridge bay 150 and the duct opening 160 before exiting through the outlet opening 60, as is shown. At the low-power setting of the fan 170, the airflow AF can be sufficient to provide required cooling for the various internal components of the imaging apparatus 100, such as the imaging portion 190.

Figure 3:
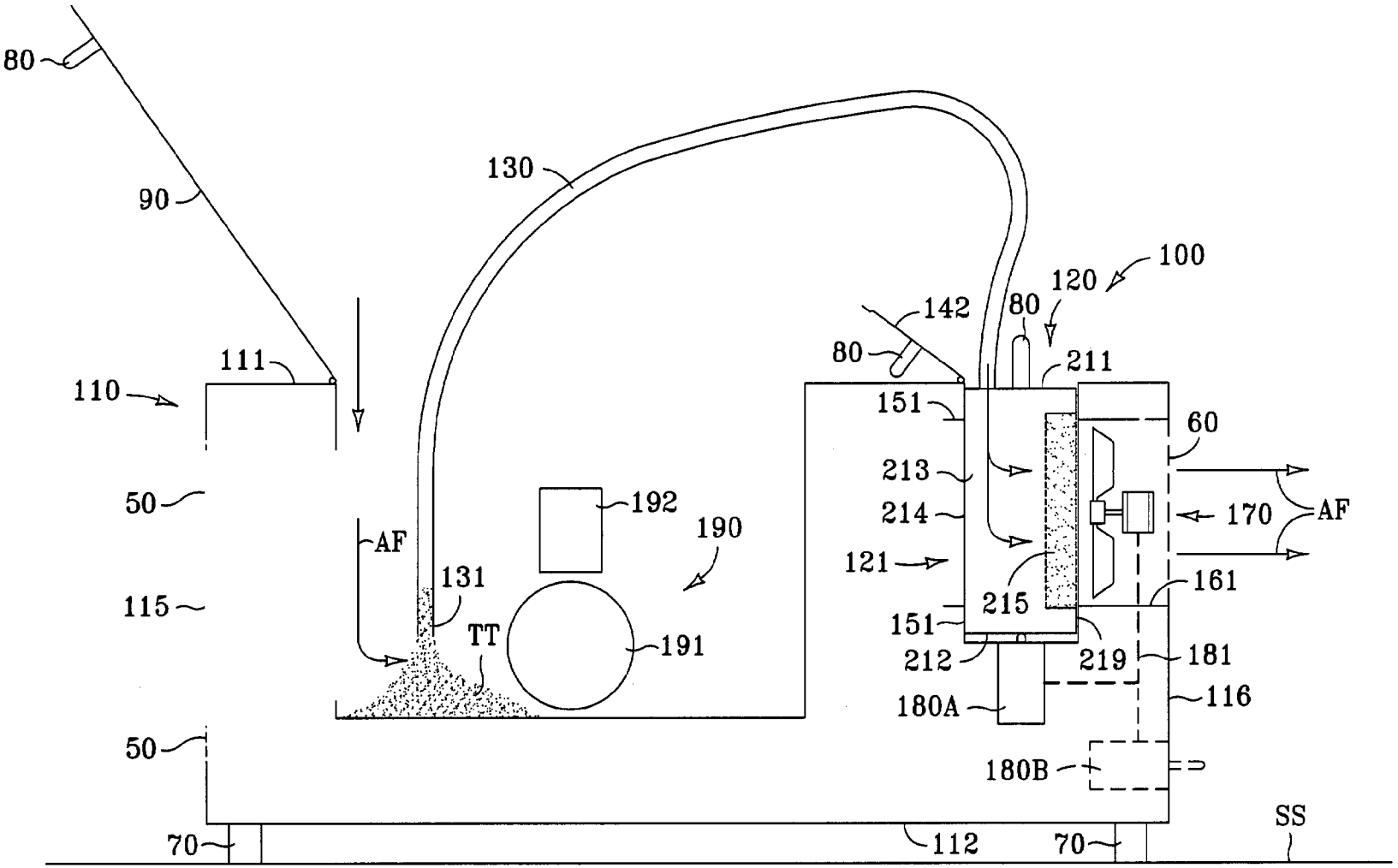
FIG. 3 is another side elevation schematic drawing of the imaging apparatus depicted in FIG. 1 showing the imaging apparatus in cleaning operational mode.

Turning now to FIG. 3, another side elevation schematic diagram is shown in which the imaging apparatus 100 is depicted. As is shown in FIG. 3, the vacuum filter cartridge 120 has been placed into its operable position within the housing 110. That is, the vacuum filter cartridge 120 is depicted as being supported within the housing 110, and more specifically, within the cartridge bay 150. As is seen, the guides 151 can serve to positionally support the vacuum filter cartridge 120 while the cartridge is located in its operable position within the housing 110. Furthermore, it is seen that the seal 219 can serve to substantially seal the vacuum cartridge 120 to the wall 161, whereby substantially all of the airflow AF that is induced to move through the housing 110 by the fan 170 is also caused to flow into the vacuum filter cartridge and then through the filter element 215, as is shown.

More specifically, the portal panel 142 can first be opened to expose the portal 140 before the vacuum filter cartridge 120 is placed into its operable position within the housing 110. The vacuum filter cartridge 120 can then be placed into its operable position within the housing 110 so that it is located in operable relation to the fan 170. The guides 151 can serve to positionally support the vacuum filter cartridge 120 in a manner wherein the seal 219 is sealingly engaged between the wall 161 and the shell 121. Additionally, while the vacuum filter cartridge 120 is located in its operable position within the housing 110, the switch 180A, 180B can be activated so as to cause the fan 170 to operate at the high-power setting, as is described above in greater detail.

The switch 180A can be automatically activated by placement of the vacuum filter cartridge 120 within the housing 110 such as in the case wherein the switch is a proximity switch as explained above. Alternatively, the switch 180B can be manually activated by an operator or the like, such as in the case wherein the switch is a manually operable switch as is also explained above. As is further discussed above, either of the switch configurations 180A, 180B can be employed singly, or alternatively, both switch configurations 180A, 180B can be concurrently employed. In any case, the operation of the fan 170 at the high-power setting while the vacuum filter cartridge 120 is in its operable position within the housing 110 can render the vacuum filter cartridge, together with the attached hose 130, operable as a cleaning device, whereby various debris TT can be recovered and ultimately disposed of in a proper manner.

More specifically, the imaging apparatus 100 can be selectively operated in a cleaning mode as is depicted in FIG. 3, wherein the vacuum filter cartridge 120 is first placed into its operable position within the housing 110 as described above. The switch 180A, 180B can then be activated in any of the manners described above so as to cause the fan 170 to operate in the high-power setting. As can be appreciated, the orientation of the vacuum filter cartridge 120, as well as its location, relative to the housing 110 and the fan 170 can result in a substantial airflow AF into the nozzle 131, then through the hose 130, then into the vacuum filter cartridge 120, then through the filter element 215, then through the duct opening 160, and then through the fan 170, and finally, out of the outlet opening 60.

As can also be appreciated, debris TT and other such particulate matter, can become airborne by way of the airflow AF, whereby such debris and matter can be inducted into the hose 130 along with the airflow. After the debris TT and/or other matter enters the vacuum filter cartridge 120, it can be separated from the airflow within the shell 121 of the vacuum filter cartridge before the airflow exits the vacuum filter cartridge via the filter element 215. Once the airflow exits the vacuum filter cartridge 120, it can then pass through the fan 170 to be expelled from the housing 110 via the outlet opening 60.

By operation of the imaging apparatus 100 in the cleaning mode thus described immediately above, the debris TT can be conveniently removed from the area of the imaging portion 190, as well as other areas in and around the apparatus. The debris TT thus removed can be captured within the vacuum filter cartridge 120 by employing the hose 130 and attached nozzle 131 in the manner of a conventional vacuum cleaner.

That is, for example, with the vacuum filter cartridge 120 installed within the housing 110 as is depicted, the panel 90 can be opened to expose the imaging portion 190, or other area internal to the housing. Then, with the fan 170 in the high power setting, the hose 130 and attached nozzle 131 can be manipulated so as to induct the debris TT into the hose, whereby the debris can be captured within the vacuum filter cartridge 120. The vacuum filter cartridge 120, upon becoming full of like debris TT, can then be disposed with the debris, and a new, empty vacuum filter cartridge can be employed in its place.

Figure 4:
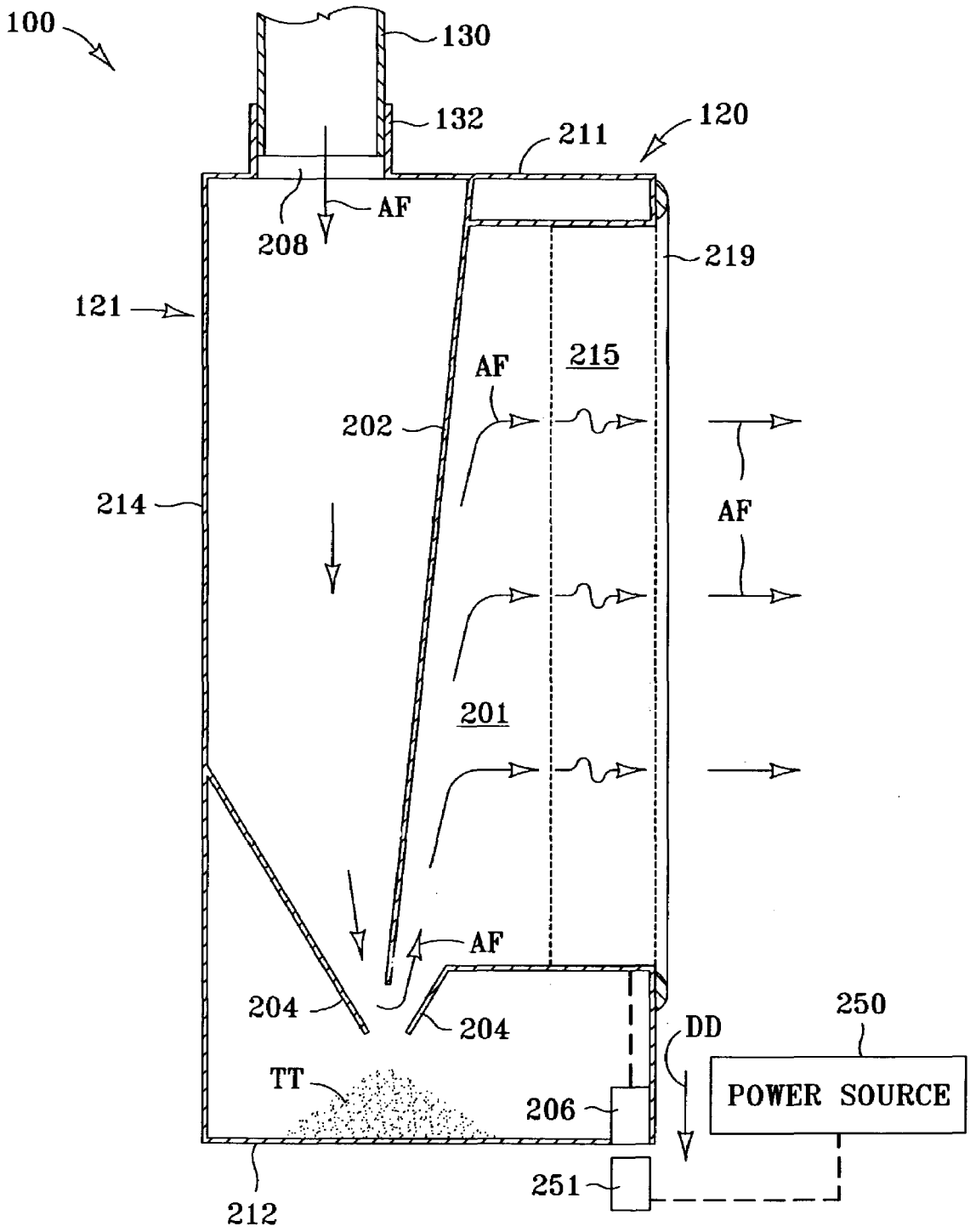
FIG. 4 is a side elevation detail sectional view of the vacuum filter cartridge in accordance with another embodiment of the present invention.

Now moving to FIG. 4, a detail side elevation sectional view is shown in which the vacuum filter cartridge 120 is depicted. In keeping with the disposable nature of the vacuum filter cartridge 120 in accordance with one embodiment of the present invention, the shell 121 can be fabricated in a simple and economical manner. For example, the shell 121 can be fabricated from molded plastic such as by injection molding or blow molding. Likewise, the filter element 215 can be fabricated from inexpensive materials and integrally attached to the shell 121. The seal 219 can similarly be fabricated, and can also be integrally formed with the shell 121. While the seal 219 can be supported on the shell 121 as depicted, it is understood that the seal can alternatively be supported on the wall 161.

As is seen from a study of FIG. 4, and as is described above, the airflow AF and debris TT can enter the shell 121 by way of the hose 130. The hose 130 can include a coupling 132 that can enable the selective attachment and detachment of the hose relative to the vacuum filter cartridge 120. That is, the coupling 132 can be configured to allow the hose 130 to be selectively attached to the vacuum filter cartridge 120 and detached therefrom as well. In this manner, the hose 130 can be detached from the vacuum filter cartridge 120 prior to disposal thereof, thus saving the cost of the hose. The hose 130 can then be reused by attachment thereof, via the coupling 132, to a new vacuum filter cartridge 120.

As can be appreciated from a study of FIG. 4, the useful life of the filter element 215 can be extended by the employment of a baffle plate 202 and a trap 204. That is, by including a baffle plate 202 and a trap 204 in the general manner shown and described herein, as well as in other known manners, a substantial amount of debris TT can be separated from the airflow AF and captured within the shell 121 before reaching the filter element 215 and clogging it.

Baffle plates and traps such as the baffle plate 202 and trap 204 are generally well known in the art and function to remove particulate matter from an air stream by advantageously employing the greater density of the particulate matter as compared with the air. That is, by causing the airflow AF to circumvent a tight corner at the end of the baffle plate 202 at a high rate of speed, the airborne debris TT is forced, by virtue of its greater momentum, to continue traveling downward and into the trap 204 where it is captured before reaching the filter element 215.

The filter element 215 can have any of a number of possible specific forms and/or configurations. For example, the filter element 215 can be a conventional folded paper-type filter element similar to that of an automobile engine air intake filter. Alternatively, or additionally, the filter element 215 can comprise other materials such as cotton or synthetic fibers and/or fabric as well as foam and/or oil and the like. As yet a further alternative, the filter element 215 can be an electrostatic filter element. Both conventional paper-type filter elements, as well as foam, and electrostatic filter elements, are known in the art.

As a further alternative, the filter element 215 can be an electronic filter element. Electronic filter elements are also known in the art and generally require operational electrical power from an external power source. Thus, as is depicted in FIG. 4, the vacuum filter cartridge 120 can include an external power contact 206 which can be supported on the shell 121 and connected in power transmitting linkage with the filter element 215, wherein the filter element can be an electronic filter.

The power contact 206 can be, for example, an electrical contact or the like that is configured to transmit electrical power. The power contact 206 can be configured to connect with a corresponding contact 251 which can be supported within the cartridge bay 150 as is described above. The contact 251, in turn, can be connected to a power supply 250 which can be configured to supply the required operational power to the filter element 215 by way of the power contact 206 and contact 251 when in connection with one another for power transmission there between.

For example, the contact 251 can be supported within the housing 110 (shown in FIGS. 1 through 3). The power source 250 can also be supported within the housing 110, or can alternatively be located remotely outside of the housing. The power contact 206 can thus connect with the contact 251 for power transmission there between by movement of the vacuum filter cartridge 120 in the direction indicated by the arrow marked DD. Such movement of the vacuum filter cartridge 120 can be attained, for example, during placement of the vacuum filter cartridge into its operable position within the housing 110. In this manner, the filter element 215 can be in the form of an electronic filter element that draws operational power from the external power source 250.

As can be appreciated from the foregoing discussion, the apparatus in accordance with any of the various embodiments of the present invention can serve to provide a convenient means of cleaning an imaging device as well as other devices and/or areas external to the imaging device.

In accordance with yet another embodiment of the present invention, a method of cleaning an imaging apparatus includes providing a vacuum filter cartridge. The vacuum filter cartridge can be substantially similar to the vacuum filter cartridge 120 that is described above with regard to the accompanying figures. The vacuum filter cartridge, in accordance with the method, can include a hose operatively connected thereto.

The vacuum filter cartridge can be operatively supported on the imaging apparatus, wherein the vacuum filter cartridge can be employed to clean the imaging apparatus. For example, airflow can be induced through the vacuum filter cartridge, as well as through the hose connected thereto while the vacuum filter cartridge is operatively supported on the imaging apparatus. Airflow can also be induced through the imaging apparatus.

That is, and as explained above with respect to the apparatus 100, air can be induced to flow into and through the hose as well as through the vacuum filter cartridge in accordance with the method. That is, in accordance with the method, an air movement device, such as a fan or the like, can be employed to cause airflow into one end of the hose and then through the hose and into the vacuum filter cartridge. The airflow can be caused to continue through and out of the vacuum filter cartridge. The airflow can be filtered as it passes through the vacuum filter cartridge. The terms "filter" and "filtered," as used herein in conjunction with the description of the method or methods, refer to the removal of particulate matter from the airflow.

More specifically, for example, airflow can be induced to flow into and through the hose and through the vacuum filter cartridge by way of a fan that can be provided. While moving through the vacuum filter cartridge, the air can be filtered so as to remove particulate matter therefrom. The fan can be operatively supported by the imaging apparatus as is described above with respect to the apparatus 100. If the fan is operatively supported on the imaging apparatus, then the air flowing out of the vacuum filter cartridge can flow through at least a portion of the imaging apparatus while being moved by the fan.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An imaging apparatus configured to produce images on media, comprising:

an imaging portion;

a housing which substantially encloses the imaging portion;

a fan comprising a blade portion; and, a wall supported within the housing, which substantially enshrouds the blade portion and defines a duct opening through which substantially all airflow passes before exiting the housing, wherein temporary placement of a vacuum filter cartridge in an operable position within the housing causes the duct opening to be substantially blocked by the cartridge, whereby operation of the fan induces operable airflow through the cartridge and a hose attached thereto.

2. The apparatus of claim 1, and further comprising a fan which is supported within the housing, and which is operable to induce airflow through the hose and the vacuum filter cartridge when the vacuum filter cartridge is in its operable position within the housing.

3. The apparatus of claim 2, and further comprising a switch in operable connection with the fan, whereby activation of the switch effects the operation of the fan.

4. The apparatus of claim 3, and wherein the switch is supported on the housing and positioned relative thereto such that the switch can be manually activated.

5. The apparatus of claim 2, and wherein the fan is configured to operate at a high-power setting and at a low-power setting, and wherein activation of the switch causes the fan to operate at the high-power setting.

6. An imaging apparatus configured to produce images on media, comprising:

an imaging portion;

a housing which substantially encloses the imaging portion, and which defines therethrough a portal, wherein a vacuum filter cartridge including an attached hose can be placed in an operable position within the housing by way of the portal, wherein the hose operatively protrudes therethrough;

a fan which is supported within the housing, and which is operable to induce airflow through the hose and the vacuum filter cartridge when the vacuum filter cartridge is in its operable position within the housing; and, a switch in operable connection with the fan, whereby activation of the switch effects the operation of the fan, wherein the switch is supported within the housing and positioned relative thereto such that placement of the vacuum filter cartridge within its operable position causes activation of the switch.

7. An imaging apparatus configured to produce images on media, comprising:

an imaging portion;

a housing which substantially encloses the imaging portion, wherein a vacuum filter cartridge including an attached hose can be temporarily placed in an operable position within the housing;

a fan comprising a blade portion, wherein the fan is operable to induce airflow to enter the housing and to exit the housing; and, a wall supported within the housing, which substantially enshrouds the blade portion and defines a duct opening through which substantially all airflow passes before exiting the housing, wherein placement of the vacuum filter cartridge in the operable position causes the duct opening to be substantially blocked by the cartridge, whereby operation of the fan induces operable airflow through the hose and the cartridge.

8. An imaging apparatus configured to produce images on media, comprising:

an imaging portion;

a housing which substantially encloses the imaging portion, wherein the housing defines there through an inlet opening, an outlet opening, and a portal, and wherein a vacuum filter cartridge including an attached hose can be placed in an operable position within the housing by way of the portal with the hose operatively protruding therethrough;

a fan comprising a motor portion and a blade portion in operable connection with the motor portion, wherein the fan is configured to operate at a high-power setting and a low-power setting, and wherein the fan is operable to induce airflow to enter the housing by way of the inlet opening, and to exit the housing by way of the outlet opening; and, a wall which is supported within the housing, and which enshrouds the blade portion and defines a duct opening through which substantially all airflow passes before exiting the housing by way of the outlet opening, and wherein placement of the vacuum filter cartridge in its operable position causes the duct opening to be substantially blocked by the vacuum filter cartridge, whereby operation of the fan induces operable airflow through the hose and the vacuum filter cartridge.

9. The apparatus of claim 8, and further comprising a switch in operable connection with the fan, whereby activation of the switch causes the fan to operate at the high-power setting and deactivation of the switch causes the fan to operate at the low-power setting.

10. The apparatus of claim 9, and wherein the switch is manually operable and supported on the housing and positioned relative thereto, whereby manual operation of the switch is facilitated.

11. An imaging apparatus configured to produce images on media, comprising:

an imaging portion;

a housing which substantially encloses the imaging portion, wherein the housing defines there through an inlet opening, an outlet opening, and a portal, and wherein a vacuum filter cartridge including an attached hose can be placed in an operable position within the housing by way of the portal with the hose operatively protruding therethrough; and, a fan comprising a motor portion and a blade portion in operable connection with the motor portion, wherein the fan is configured to operate at a high-power setting and a low-power setting, and wherein the fan is operable to induce airflow to enter the housing by way of the inlet opening, and to exit the housing by way of the outlet opening;

a wall which is supported within the housing, and which enshrouds the blade portion and defines a duct opening through which substantially all airflow passes before exiting the housing by way of the outlet opening, and wherein placement of the vacuum filter cartridge in its operable position causes the duct opening to be substantially blocked by the vacuum filter cartridge, whereby operation of the fan induces operable airflow through the hose and the vacuum filter cartridge; and, a switch in operable connection with the fan, whereby activation of the switch causes the fan to operate at the high-power setting and deactivation of the switch causes the fan to operate at the low-power setting, and wherein the switch is a proximity switch supported within the housing and positioned relative thereto, whereby placement of the vacuum filter cartridge in its operable position brings the vacuum filter cartridge into proximity of the switch, causing the switch to be activated, and whereby removal of the vacuum filter cartridge from its operable position causes deactivation of the switch.

12. An imaging apparatus including an imaging portion configured to produce images on media, the apparatus comprising:

a housing which substantially encloses the imaging portion, and wherein the housing defines there through an inlet opening, an outlet opening, and a portal, and wherein a vacuum filter cartridge can be placed in an operable position within the housing;

a fan comprising a motor portion and a blade portion in operable connection with the motor portion, wherein the fan is configured to operate at a high-power setting and a low-power setting, and wherein the fan is operable to induce airflow to enter the housing by way of the inlet opening, and to exit the housing by way of the outlet opening; and, a wall which is supported within the housing, and which enshrouds the blade portion and defines a duct opening through which substantially all airflow passes before exiting the housing by way of the outlet opening, and wherein placement of the vacuum filter cartridge in its operable position causes the duct opening to be substantially blocked by the vacuum filter cartridge, whereby operation of the fan induces operable airflow through the vacuum filter cartridge.

13. The apparatus of claim 12, and further comprising a vacuum filter cartridge configured to be placed in an operable position within the housing, the vacuum filter cartridge comprising:

a shell which partially encloses a vacuum chamber, wherein a hose opening is defined through the shell;

a filter element which is supported by the shell and which, together with the shell, substantially encloses the vacuum chamber except for the hose opening, wherein the filter cartridge is configured to be placed in an operative position within the housing, whereby the fan can be operated to induce airflow into the vacuum chamber by way of the hose opening and out of the chamber by way of the filter element.

14. The apparatus of claim 13, and further comprising a switch in operable connection with the fan, whereby activation of the switch causes the fan to operate at the high-power setting and deactivation of the switch causes the fan to operate at the low-power setting.

15. The apparatus of claim 14, wherein the switch is manually operable and supported on the housing and positioned relative thereto, whereby manual operation of the switch is facilitated.

16. An imaging apparatus including an imaging portion configured to produce images on media, the apparatus comprising:

a housing which substantially encloses the imaging portion, and wherein the housing defines there through an inlet opening, an outlet opening, and a portal, and wherein a vacuum filter cartridge can be placed in an operable position within the housing;

a fan comprising a motor portion and a blade portion in operable connection with the motor portion, wherein the fan is configured to operate at a high-power setting and a low-power setting, and wherein the fan is operable to induce airflow to enter the housing by way of the inlet opening, and to exit the housing by way of the outlet opening;

a wall which is supported within the housing, and which enshrouds the blade portion and defines a duct opening through which substantially all airflow passes before exiting the housing by way of the outlet opening, and wherein placement of the vacuum filter cartridge in its operable position causes the duct opening to be substantially blocked by the vacuum filter cartridge, whereby operation of the fan induces operable airflow through the vacuum filter cartridge;

a proximity switch in operable connection with the fan, and supported within the housing and positioned relative thereto, whereby activation of the switch causes the fan to operate at the high-power setting and deactivation of the switch causes the fan to operate at the low-power setting; and, a vacuum filter cartridge configured to be placed in an operable position within the housing, whereby placement of the vacuum filter cartridge in its operable position brings the vacuum filter cartridge into proximity of the proximity switch, causing the proximity switch to be activated, and whereby removal of the vacuum filter cartridge from its operable position causes deactivation of the proximity switch, the vacuum filter cartridge comprising:

a shell which partially encloses a vacuum chamber, wherein a hose opening is defined through the shell; and, a filter element which is supported by the shell and which, together with the shell, substantially encloses the vacuum chamber except for the hose opening, wherein the filter cartridge is configured to be placed in an operative position within the housing, whereby the fan can be operated to induce airflow into the vacuum chamber by way of the hose opening and out of the chamber by way of the filter element.

17. An imaging apparatus, comprising:

a housing substantially enclosing an imaging portion;

a fan comprising a blade portion;

a wall supported within the housing, which substantially enshrouds the blade portion; and, a duct opening defined through the wall, wherein:

substantially all airflow induced by the fan passes through the duct opening before exiting the housing;

placement of a vacuum filter cartridge in an operable position within the housing causes the duct opening to be substantially blocked by the cartridge; and, operation of the fan with the cartridge in the operable position induces airflow through the cartridge.

18. The apparatus of claim 17, further comprising a hose connected to the cartridge, wherein operation of the fan with the cartridge in the operable position induces airflow through the hose.

* * * * *